US005471812A

United States Patent [19]

Muller

[11] Patent Number: 5,471,812

[45] Date of Patent: Dec. 5, 1995

[54] METHOD FOR FABRICATING PRETENSIONED CONCRETE STRUCTURES

[76] Inventor: Jean Muller, 13 Rue Victor Hugo, 92150 Suresnes, France

[21] Appl. No.: 91,812

[22] Filed: Jul. 13, 1993

[51] Int. Cl.[6] ..... E04C 3/20; E04C 5/00; E04G 21/12

[52] U.S. Cl. ..... 52/745.19; 52/741.1; 52/726.2; 52/233.8; 52/223.14; 52/724.1; 52/742.14; 264/228; 264/308

[58] Field of Search ..... 52/745.19, 743, 52/741.1, 223.8, 223.14, 722, 726.2; 264/228, 229, 308, 256

[56] References Cited

U.S. PATENT DOCUMENTS

| | | | |
|---|---|---|---|
| 3,029,490 | 4/1962 | Middendorf | 264/228 |
| 3,041,702 | 7/1962 | Schwab | 264/228 |
| 3,049,786 | 8/1962 | Jones | 52/223.8 X |
| 3,757,477 | 9/1973 | McCrillis et al. | 52/79.1 |
| 3,819,794 | 6/1974 | Kidron | 264/228 |

*Primary Examiner*—Carl D. Friedman
*Assistant Examiner*—Robert J. Canfield
*Attorney, Agent, or Firm*—Baker, Maxham, Jester & Meador

[57] ABSTRACT

A novel method for fabricating pretensioned concrete structures includes the steps of:

(a) arranging one or more cables between a first anchoring station and a second anchoring station;

(b) tensioning the cables between the anchoring stations at a selected tension load and in a selected cable position;

(c) casting one or more concrete structures around the cables at a selected location between said anchoring stations; and (d) repeating steps (b) and (c) using different tension load and/or cable position selections in step (b).

18 Claims, 2 Drawing Sheets

METHOD FOR FABRICATING PRETENSIONED CONCRETE STRUCTURES

BACKGROUND OF THE INVENTION

The present invention is directed generally to reinforced concrete structures, and more particularly to pretensioned concrete structures such as beams and other load-bearing members wherein the structures are placed in initial compression in order to increase their flexural load bearing capacity.

Pretensioned concrete structures have been formed by casting concrete around pretensioned steel cables. When the concrete has set, the tension on the steel cables is released and the consequent relaxation of the cables imparts a compressive load on the concrete structure. This initial compressive set allows the structure to react more flexural load because the tensile stress developed at maximum loading is reduced in accordance with the amount of initial compression.

A conventional prior art method and apparatus for fabricating pretensioned concrete beams is illustrated in FIGS. 1–3. A pretensioning apparatus 10 is formed from a tensioning bed 12 and a pair of anchor blocks 14 and 16 at each end of the tensioning bed 12. Each anchor block has one or more cables bores therein. Positioned at one end of the tensioning bed 12 is a cable anchor 18. Positioned at the opposite end of the tensioning bed 10 is a cable tensioning jack 20. In order to fabricate a pretensioned concrete beam, one or more cables 22 are mounted between the anchor 18 and the jack 20 and pretensioned using the jack.

Still referring to FIGS. 1–3, a pair of steel concrete form structures 24 and 26 (see FIG. 3) are positioned on the tensioning bed 12 with the cables 22 therebetween, and one or more concrete beams 28 are poured. When the concrete has set, the cables 22 are released from the anchor 18 and jack 20 and the cables are cut between the beams 28. Each beam is thus pretensioned by the cable members trapped therein.

It will be appreciated that the above-described prior art method and apparatus produce pretensioned concrete beam members in which the pretensioning is uniform along the length of the beams and in which the cables extend along a linear path through the beams. Those characteristics effectively limit the length of the beams that are producible in accordance with the prior art, for two reasons. First, uniform tension along the beam length means that for flexural structures the tension can be too high at the ends of the beam, where bending is often minimal, and too low at the center of the beam, where maximum bending usually occurs. Second, a linear cable path means that the cables do not follow the load curve of the beam. Thus, the amount of pretensioning may be excessive at some locations on the beam and insufficient at others. This limits the maximum length of prior art pretensioned concreted structures to approximately 100 feet.

Accordingly, there is an evident need for a system for fabricating pretensioned concrete structures that overcomes the deficiencies of the prior art. A new technique is required that would allow the formation of concrete beams and other structures well in excess of the beam lengths allowed by the prior art, and in which efficiencies are maximized by matching the pretensioning more precisely to the loading pattern of the structure.

SUMMARY OF THE INVENTION

In accordance with the foregoing objectives, the present invention provides a novel system for fabricating pretensioned concrete structures that overcomes the deficiencies of the prior art. In preferred embodiments, the invention is incorporated in a method that includes the steps of:

(a) arranging one or more cables between a first anchoring station and a second anchoring station;

(b) tensioning the cables between the anchoring stations at a selected tension load and in a selected cable position;

(c) casting one or more concrete structures around the cables at a selected location between the anchoring stations; and (d) repeating steps (b) and (c) using different tension load and/or cable position selections in step (b) until a composite structure of desired configuration is achieved.

Advantageously, the number of concrete structures may be varied for each iteration of steps (b) and (c). In addition, the cable tension loading for one or more of the cables may either by decreased, increased or not changed at all during successive iterations. Similarly, the position of one or more of the cables may be changed or remain fixed during successive iterations, as desired.

BRIEF DESCRIPTION OF THE DRAWINGS

The objects, advantages and features of the present invention will be more clearly understood by reference to the following detailed disclosure and the accompanying drawing in which.

DETAILED DESCRIPTION OF THE PREFERRED EMBODIMENTS

Figure 4:
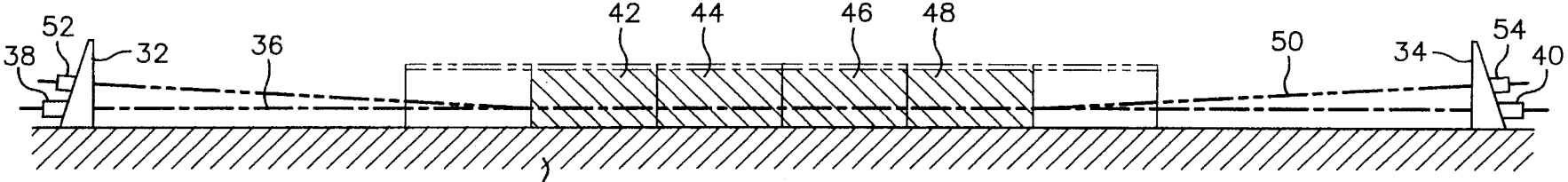
FIG. 4 is a diagrammatic side view illustrating first and second steps of a method performed in accordance with the present invention.

Referring now to FIG. 4, the invention may be embodied in a pretensioned concrete fabrication method which advantageously utilizes some of the apparatus components found in the prior art pretensioning apparatus. Thus, FIG. 4 illustrates a pretensioning bed 30 upon which is mounted a pair of anchor blocks 32 and 34 at spaced apart locations thereon. The anchor blocks 32 and 34 are provided with one or more cable bores and one or more cables 36 are arranged so as to extend between the first and second anchor blocks 32 and 34, respectively. The cables 36 are secured to the anchor block 32 using an anchor system 38 which may include a composite anchor for plural cables, or multiple independently positionable anchors, or a combination thereof. The cables 36 are secured to the anchor block 34 using a loading jack system 40 which may include a composite jack for plural cables, or multiple independently positionable anchors, or a combination thereof. Once the cables are initially attached to the anchor blocks 32 and 34, they are tensioned to a selected tension load by adjusting the jack system 40.

Figure 1:
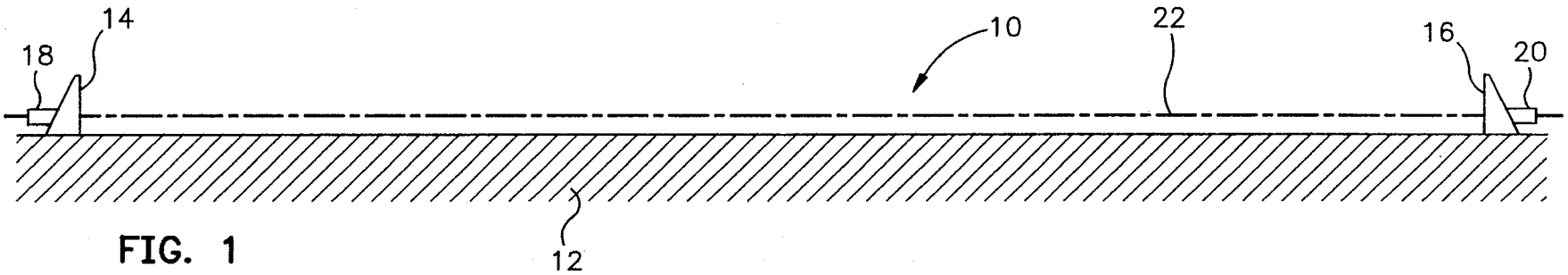
FIG. 1 (PRIOR ART)
FIG. 1 is a diagrammatic side view of a prior art apparatus for fabricating pretensioned concrete structures.
Figure 3:
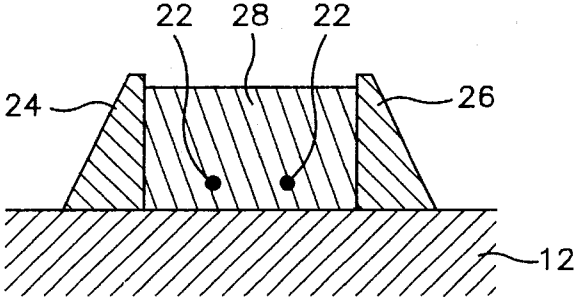
FIG. 3 (PRIOR ART)
FIG. 3 is a cross-sectional view of a pretensioned concrete structure of FIG. 2 fabricated on the prior art apparatus of FIG. 1.
Figure 2:
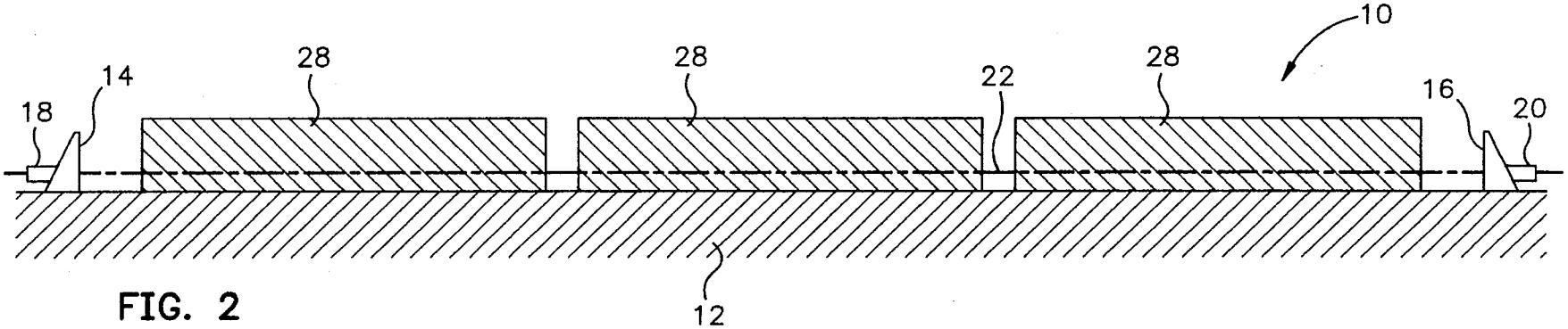
FIG. 2 (PRIOR ART)
FIG. 2 is another diagrammatic side view of the prior art apparatus of Fig. 1 showing the casting of three pretensioned concrete structures thereon.

Once the cables 36 are properly tensioned, one or more pairs of steel forms 24 and 26 similar to those shown in FIG. 3, are placed on either side of the cables 36 and one or more concrete segments, such as segments 42, 44, 46 and 48 shown in FIG. 4, are cast. The tensioning on the cables 36 is maintained until the segments 42–48 have set. Once the segments have set (typically 1–2 days), it becomes possible to adjust the tensioning and/or the positioning of one or more of the cables 36.

FIG. 4 illustrates how a selected subset 50 of the cables 36 (which subset may contain one or all of the cables 36, as described below) can be repositioned by moving the ends thereof upwardly with respect to the tensioning bed 30. This is accomplished by selecting a subset 52 of the anchor system 38, together with a subset 54 of the loading jack system 40 and sliding the members of the anchor and loading jack subsets upwardly along their respective areas of contact with the anchor blocks 32 and 34. To facilitate such positioning, the anchor blocks 32 and 34 can be provided with a greased plate that allows the anchor loading jack subset members to move relative thereto.

Figure 5:
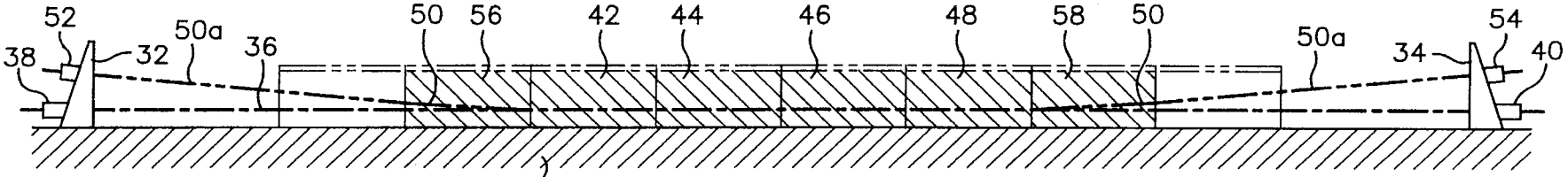
FIG. 5 is a diagrammatic side view illustrating second and third steps in accordance with the method illustrated in FIG. 4.

Although FIG. 4 illustrates a distinct subset 50 of the cables 36 being repositioned, it will be appreciated that all of the cables 36 could be so repositioned, or that as few as one of the cables 36 could be repositioned. In addition to repositioning one or more of the cables 36 in FIG. 4, the tension of one or more of the cables can be changed in order to accommodate changes in beam loading exteriorly of the concrete segments 42–48. In a simply supported beam loaded at mid-span, the maximum tensile loads would be experienced at mid-span and decrease toward the ends of the beam. Thus, the tensioning on one or more of the cables 36 can be decreased following the casting of segments 42–48 so that subsequent segments experience less pretensioning. With the cables of subset 50 repositioned as shown in FIG. 4, and with the tension of one or more of the cables 36, including one or more of the subset cables 50, being appropriately adjusted, additional concrete segments 56 and 58 can be cast as shown in FIG. 5.

Once the segments 56 and 58 have set, the cable subset 50, by way of example, is further positioned to an orientation illustrated by reference number 50*a* to accommodate subsequent casting. The repositioning of the cables 50 to the orientation shown by reference number 50*a* is achieved by sliding the members of the anchor subset 52 relative to the anchor block 32 and the members of the loading jack subset 54 relative to the anchor block 34, as previously described. As also previously described, the tension of one or more of the cables 36, including one or more of the cable subset members 50, can be adjusted prior to subsequent casting. In the case of the beam undergoing construction in FIGS. 4 and 5, the loading on the cables is decreased following casting of the concrete segments 56 and 58.

Figure 6:
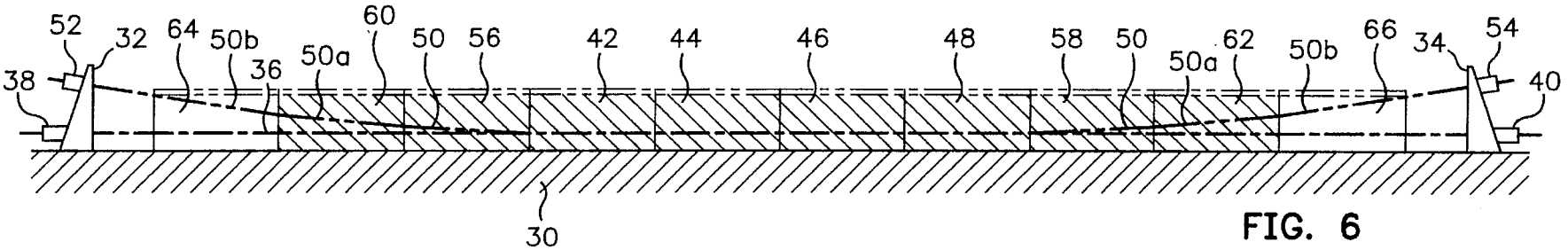
FIG. 6 is a diagrammatic side view illustrating fourth and fifth steps in accordance with the method illustrated in FIG. 4.

Referring now to FIG. 6, concrete segments 60 and 62 are cast over the cables 36, and the cable subset 50 oriented in the position illustrated by reference number 50*a*. Thereafter, the cable subset 50, by way of example, is again repositioned to the orientation illustrated by reference number 50*b*. Again, the repositioning of cable subset 50 is achieved by sliding the members of the anchor subset 52 relative to the anchor block 32 and by sliding the members of the loading jack subset 54 relative to the anchor block 34. Also, the tensioning of one or more of the cables 36, including one or more members of the cable subset 50, may be adjusted. In the case of the beam undergoing construction in FIGS. 4–6, the tensioning of the cables is decreased in anticipation of the final segments to be cast at the phantom locations shown by reference numbers 64 and 66 in FIG. 6.

Figure 7:
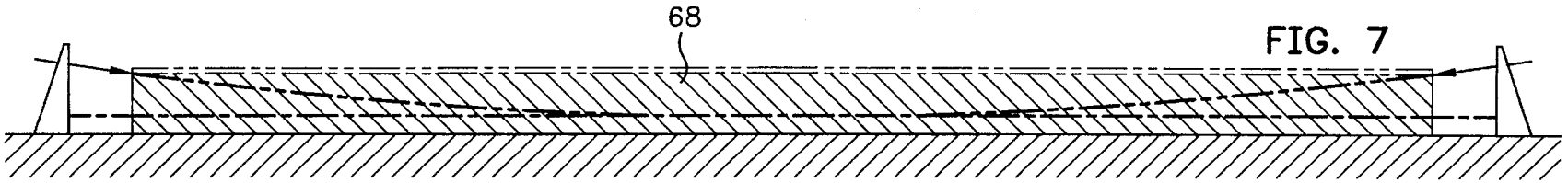
FIG. 7 is a diagrammatic side view illustrating sixth and seventh steps in accordance with the method illustrated in FIG. 4.

FIG. 7 illustrates a final composite beam 68 formed by adding concrete segments at the phantom locations 64 and 66 of FIG. 6, and thereafter cutting the cables 36 including the members of the cable subset 50 at the ends of the beam 68. The result is a continuous pretensioned concrete beam structure having a length substantially greater than that achievable using prior art techniques. It is anticipated that a composite beam 68 such as that shown in FIG. 7 could be fabricated in lengths as great as 300 to 500 feet or more, this increased length being obtainable by providing the ability to adjust the tensioning and/or positioning of the cables as the concrete structure is fabricated segment by segment.

Accordingly, a novel method for fabricating pretensioned concrete structures has been described. Although various embodiments have been disclosed, it should be apparent that many variations and alternative embodiments would be apparent to those skilled in the art in view of the teachings herein. For example, in repositioning the tensioning cables, one or more of the tensioning cables could be adjusted to any number of desired positions. The tensioning on one or all of the cables can also be selectively adjusted as segments are added in accordance with the design loads anticipated for the structure. It will be also be appreciated that the number of segments added following each adjustment of cable tension and/or position can be varied. For example, although FIG. 4 illustrates four concrete segments being initially cast, that number is arbitrary, as are the number of segments subsequently added in FIGS. 5, 6 and 7. Finally, it will be appreciated that the shape of the concrete structure is immaterial to the present invention. The structure could be a beam as shown by reference number 68 in FIG. 7, such an I-beam, a T-beam, an H-beam or the like, or the pretensioned concrete structure could be any other load bearing structure wherein the techniques of the present invention can be advantageously utilized. It will be understood, therefore, that the invention is not to be anyway limited except in accordance with the spirit of the appended claims and their equivalence.

I claim:

1. A method for fabricating pretensioned concrete structures, comprising the steps of:

(a) arranging one or more cables between a first anchoring station and a second anchoring station;

(b) tensioning said one or more cables between said anchoring stations at selected one or more tension loads and in selected one or more cable positions;

(c) casting one or more concrete structures around said cables at a selected location between said anchoring stations; and (d) repeating steps (b) and (c) using different tension loads and cable position selections in step (b) for one or more of said cables until a composite structure of desired configuration is constructed.

2. The method of claim 1 wherein step (d) includes decreasing the selected cable tension of step (b) for at least one repetition of step (b).

3. The method of claim 1 wherein step (d) includes decreasing the selected cable tension of step (b) each time step (b) is repeated.

4. The method of claim 1 wherein step (d) includes changing the selected cable position of step (b) by changing the position of said one or more cables at one or both of the anchoring stations.

5. The method of claim 1 wherein step (d) includes repeating steps (b) and (c) after a single concrete structure is cast in step (c).

6. The method of claim 1 wherein step (d) is repeated until the concrete structures formed in step (c) form a composite concrete structure in excess of about 100 feet.

7. The method of claim 1 wherein step (a) includes arranging a plurality of cables between the anchorings station and wherein step (d) includes changing the selected cable position of step (b) for all of said cables.

8. The method of claim 1 wherein step (a) includes arranging a plurality of cables between the anchoring station and wherein step (d) includes changing the selected cable tension of step (b) for all of said cables.

9. A method for fabricating a pretensioned concrete structure using an apparatus for pretensioning a concrete structure, the apparatus including a tensioning bed, first and second anchor blocks at spaced apart locations on the tensioning bed, the anchor blocks having one or more cable bores formed therein, said method comprising the steps of:

(a) arranging one or more cables between said first and second anchor blocks; and (b) iteratively performing the steps of (i) tensioning said one or more cables between said anchor blocks at selected tension loads and cable positions, and (ii) casting one or more concrete structures around said cables until a composite concrete structure of desired configuration is constructed; and (c) changing the selected cable position of at least one cable for at least one iteration of step (b).

10. The method of claim 9 wherein step (b) includes decreasing the selected cable tension of all cables for each iteration of step (b) is repeated.

11. The method of claim 9 wherein step (b) includes decreasing the selected cable tension of at least one cable for at least one iteration of step (b).

12. The method of claim 9 wherein step (b) includes changing the selected cable position of all cables for each iteration of step (b).

13. The method of claim 9 wherein step (b) includes changing the selected cable position of said one or more cables at one or both of the anchor blocks.

14. The method of claim 9 wherein step (b) is repeated until a composite concrete structure in excess of about 100 feet is formed.

15. The method of claim 9 wherein step (b) includes arranging a plurality of cables between the anchors and changing the selected cable position for all of said cables for at least one iteration of step (b).

16. The method of claim 9 wherein step (b) includes arranging a plurality of cables between the anchors and changing the selected cable tension for all of said cables for at least one iteration of step (b).

17. A method for fabricating a pretensioned concrete structure using an apparatus for pretensioning a concrete structure, the apparatus including a tensioning bed, a pair of first and second anchoring stations at spaced apart locations on the tensioning bed, the anchoring stations having one or more cable bores formed therein and anchors for securing one or more cables, said method comprising the steps of:

(a) arranging one or more cables between said first anchoring station and said second anchoring station;

(b) tensioning said one or more cables between said anchoring stations at selected tension loads and in selected cable positions representing predetermined distances above said tensioning bed;

(c) casting one or more concrete structures around said one or more cables at a selected location between said anchoring stations, using said tensioning bed as a lower base; and (d) repeating steps (b) and (c) using successively increasing cable position selections in step (b), said cable position selections being increased by adjusting said cable anchors to raise the height of said cables above said tensioning bed.

18. The method of claim 17 wherein step (d) includes successively decreasing cable tension load selections.

* * * * *

UNITED STATES PATENT AND TRADEMARK OFFICE

CERTIFICATE OF CORRECTION

PATENT NO. : 5,471,812

DATED : December 5, 1995

INVENTOR(S) : Muller, Jean

It is certified that error appears in the above-indentified patent and that said Letters Patent is hereby corrected as shown below:

Claim 7, column 5, lines 14-15, "anchorings station" should be --anchoring stations--.

Claim 8, column 5, line 18, "anchoring station" should be --anchoring stations--.

Claim 10, column 5, line 39, delete "is repeated".

Signed and Sealed this

Ninth Day of April, 1996

Bruce Lehman

*Attest:*

BRUCE LEHMAN

*Attesting Officer*

*Commissioner of Patents and Trademarks*